US006385230B1

(12) United States Patent
Reed

(10) Patent No.: US 6,385,230 B1
(45) Date of Patent: May 7, 2002

(54) HOMOGENEOUS ELECTRODE OF A REACTIVE METAL ALLOY FOR VACUUM ARC REMELTING AND A METHOD FOR MAKING THE SAME FROM A PLURALITY OF INDUCTION MELTED CHARGES

(75) Inventor: D. Scott Reed, Monroe, OH (US)

(73) Assignee: Floswerve Manage Company, Irving, TX (US)

( * ) Notice: Subject to any disclaimer, the term of this patent is extended or adjusted under 35 U.S.C. 154(b) by 0 days.

(21) Appl. No.: 09/808,573

(22) Filed: Mar. 14, 2001

(51) Int. Cl.[7] ..... H05B 7/06

(52) U.S. Cl. ..... 373/88; 373/56; 373/59; 373/90; 373/97

(58) Field of Search ..... 373/1, 2, 4, 7, 373/56, 59, 60, 67, 88, 89, 90, 97, 98, 42; 75/10.14, 10.18, 10.26, 10.67

(56) References Cited

U.S. PATENT DOCUMENTS

| | | | | |
|---|---|---|---|---|
| 3,051,555 A | | 8/1962 | Rummel | |
| 3,203,794 A | | 8/1965 | Jaffe et al. | |
| 3,476,586 A | * | 11/1969 | Valtchev et al. | 373/88 |
| 3,775,091 A | | 11/1973 | Clites et al. | |
| 4,004,076 A | * | 1/1977 | Paton et al. | 373/90 |
| 4,058,668 A | | 11/1977 | Clites | |
| 4,133,969 A | | 1/1979 | Zumbrunnen | |
| 4,738,713 A | | 4/1988 | Stickle et al. | |
| 4,923,508 A | | 5/1990 | Diehm et al. | |
| 5,124,122 A | | 6/1992 | Wojcik | |
| 5,176,762 A | | 1/1993 | Berczik | |
| 5,209,790 A | | 5/1993 | Wojcik | |
| 5,226,946 A | | 7/1993 | Diehm et al. | |
| 5,283,805 A | | 2/1994 | Kawano et al. | |
| 5,311,655 A | | 5/1994 | Jager et al. | |
| 5,974,077 A | | 10/1999 | Abiko et al. | |
| 6,113,666 A | | 9/2000 | Kompan et al. | |
| 6,144,690 A | | 11/2000 | Kusamichi et al. | |

* cited by examiner

*Primary Examiner*—Tu Ba Hoang
(74) *Attorney, Agent, or Firm*—Killworth, Gottman, Hagan & Schaeff, L.L.P.

(57) ABSTRACT

A homogeneous electrode of reactive metal alloy comprises an ingot with an axially disposed core made from one induction melted heat of the reactive metal alloy and having a diameter "d" and a length "L" and a body having an outer diameter at least √2 times "d" and a length "L". The ingot body is disposed about the core, and comprises a plurality of induction melted heats of the reactive metal alloy to provide an electrode of the required size. The electrode also includes features for receiving electrical current for arc remelting of the reactive metal alloy to produce a large homogeneous ingot. Remelting may be conducted under vacuum or controlled atmosphere conditions, as required.

10 Claims, 5 Drawing Sheets

HOMOGENEOUS ELECTRODE OF A REACTIVE METAL ALLOY FOR VACUUM ARC REMELTING AND A METHOD FOR MAKING THE SAME FROM A PLURALITY OF INDUCTION MELTED CHARGES

BACKGROUND OF THE INVENTION

This invention relates generally to processes for producing ingots of reactive metals and alloys and more particularly to a process for producing homogeneous ingots several times larger than those which can be produced from a single induction skull melted charge.

Melting of reactive metal alloys containing Titanium, Zirconium, or other reactive elements is usually done in a vacuum, in an inert atmosphere, or in a partial pressure of gas which is non-reactive with the alloy constituents. Such non-reactive atmosphere melting preferably employs induction melting or arc melting in a cold crucible or mold, usually of water-cooled copper, to eliminate contamination from mold washes or from the mold itself. These melting methods, both of which are very well known in the metallurgical art, produce ingots of excellent purity; however, induction melting and vacuum arc melting each have limitations which result in ingots having less than ideal properties.

Induction skull melting (ISM) produces ingots having a very high degree of cleanliness and homogeneity due to melting in a skull of the alloy being processed and to the intense stirring produced in the melt by the induction field. However, the size of induction skull melted heats is limited by the presence of the water-cooled metal crucible and the size of the controlled atmosphere chamber. The crucible limits the strength of the induction field, and the chamber limits the size of the mold and the ability to manipulate the crucible for pouring the alloy into the mold. This results in small ISM ingots—typically less than 100 pounds. Consequently, for large ingots, several ISM heats must be combined. This may be accomplished by casting several small electrodes from several ISM heats, welding the electrodes together end-to-end, and using the resulting composite electrode for vacuum arc remelting (VAR) the alloy in a water-cooled copper crucible.

However, since hot-topping during casting is not possible in the ISM melting and casting process, the resulting ingots have at least some porosity and shrinkage pipe. These defects aggravate the costliness and difficulty of producing the VAR electrode by welding. Further, since many of the reactive alloys are brittle, they also have marginal weldability and are susceptible to cracking in the welds and in the heat affected zones adjacent to the welds. Therefore, the welded composite electrodes may contain cracks and inclusions due to contamination with oxygen and nitrogen during welding. This can lead to failure of the electrodes during VAR and can result in damage to the equipment and danger to the operators thereof.

Vacuum arc melting can produce very large ingots compared to those made by ISM. Electrodes of, for example, titanium alloys for vacuum arc melting are typically made by starting with titanium sponge and/or granular master alloys and/or alloying elements, which are blended together in required proportions and compacted into briquettes of about 4" diameter and 2" thickness. The briquettes are non-homogeneous because the alloying elements are introduced as solids and are only mechanically blended. The electrode is formed by welding the briquettes together, usually using titanium welding wire, under controlled atmosphere conditions. This is a costly and time consuming process, and, at best, produces an electrode which lacks homogeneity and may include weld defects.

Typically, the electrode is melted in a vacuum arc furnace using a water-cooled copper crucible having a diameter slightly larger than that of the electrode. The resulting ingot is non-homogeneous due to the non-homogeneous electrode and to the lack of stirring in the arc melting process, and it usually contains unmelted or partially melted granules of some starting materials. The ingot is used as an electrode for VAR in a water-cooled copper crucible again having a diameter slightly larger than that of the electrode to produce a second-stage ingot. This ingot is the electrode for a third stage VAR process which produces a final triple-melted ingot. Ingots of titanium alloys, made by the VAR process, may be as large as 16,000 pounds, and although they are clean, due to vacuum melting, and free of porosity and pipe, due to the hot-topping capability of arc melting, they are non-homogeneous and may still contain oxygen and nitrogen enriched inclusions due to the welding required to produce the starting electrode. Moreover, vacuum arc melting and VAR limits alloy compositions due to the difficulty of alloying some materials by mechanically mixing and the lack of stirring during arc melting.

The foregoing illustrates limitations known to exist in present methods for producing large ingots of reactive metal alloys. Thus it would be advantageous to provide an alternative directed to overcoming one or more of those limitations. Accordingly, a suitable alternative is provided including features more fully disclosed hereinafter.

SUMMARY OF THE INVENTION

In one aspect of the present invention, this is accomplished by making a homogeneous electrode of reactive metal alloy, comprising an axially disposed unitary core made from one induction melted heat of said reactive metal alloy and having a diameter "d" and a length "L"; and a body having an outer diameter at least $\sqrt{2}$ times "d" and length "L", said body being disposed about said core, and comprising at least one induction melted heat of said reactive metal alloy, said homogeneous electrode being vacuum arc remelted to produce a homogeneous ingot.

The foregoing and other aspects of the invention will become apparent from the following detailed description, when considered in conjunction with the accompanying drawings.

DETAILED DESCRIPTION

Figure 1:
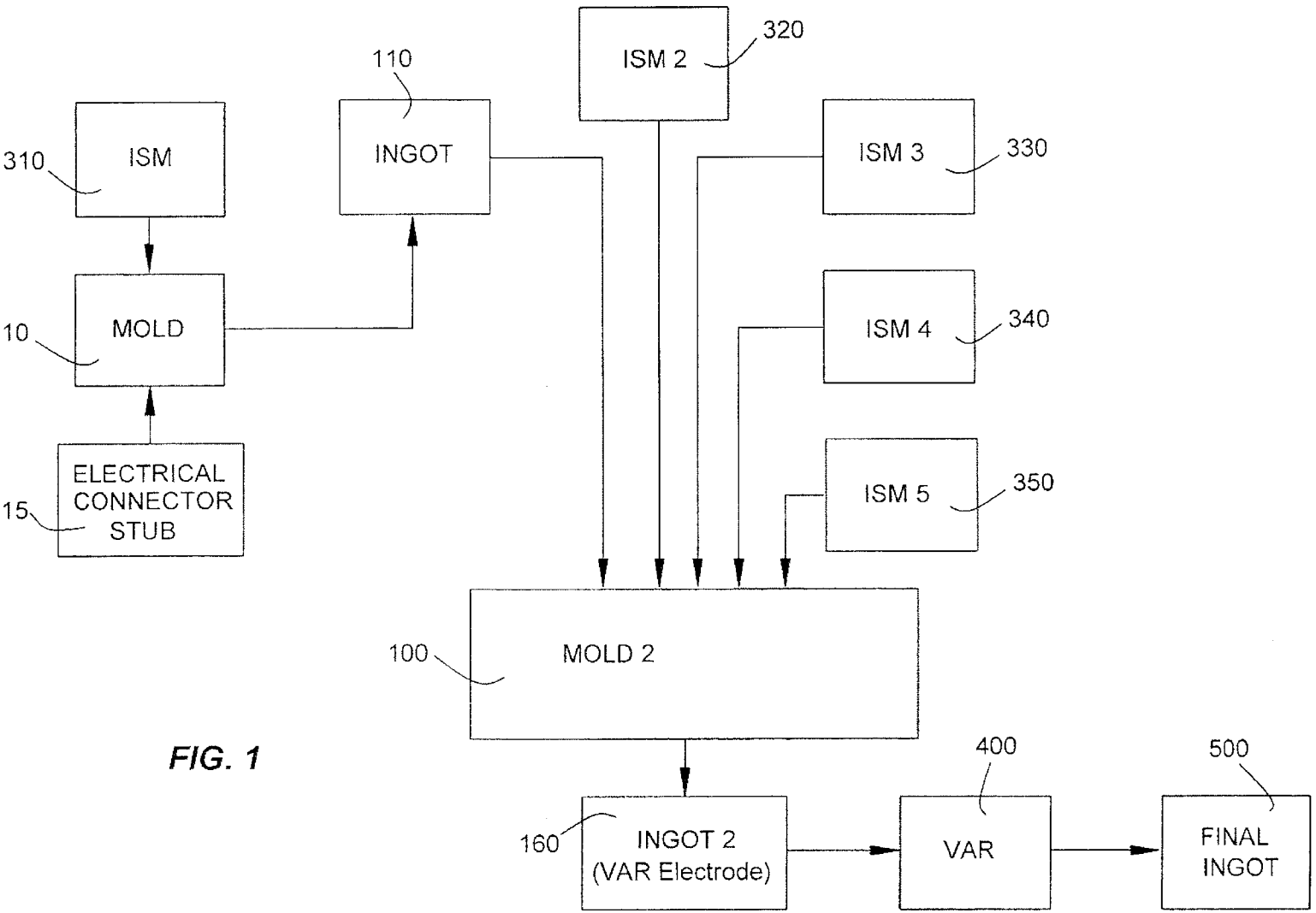
FIG. 1 is a flow chart showing the steps for making an electrode from multiple heats of induction melted reactive metal alloy and for producing an ingot by vacuum arc remelting of said electrode according to a first embodiment of the invention.

Consolidation of multiple heats of induction skull melted (ISM) reactive metal alloys (for example, titanium and zirconium-based alloys) is often necessary in order to provide castings or ingots which are too large to be made from a single ISM heat. To successfully accomplish such consolidation, the preferred process uses VAR with a homogeneous electrode made by combining several ISM heats of the alloy. The flow chart shown in FIG. 1 illustrates a method for making a homogeneous electrode, from several ISM heats of a reactive metal alloy, for VAR. An electrical connecting stub 15 is placed at the bottom of a first mold 10 with a diameter "d" and a length greater than "L", and a first induction melted heat 310 of the alloy is poured into the mold. The stub 15 has a diameter somewhat greater than the diameter "d" of the mold cavity. It also has an axially extending pin (preferably ~2" long) with a small (~1") diameter to serve as a means for, as a minimum, mechanically joining the stub to the ingot by solidification shrinkage, and the same composition as the primary constituent of the reactive metal alloy. Thus, for titanium based alloys, the stub is pure titanium. The stub 15 is partially fused by the molten alloy during casting in the mold 10, such that, when removed from the mold, the resulting ingot 110 has a diameter "d", a length "L", and a stub 15 with a diameter "$d \mp \Delta d$" fused and/or mechanically bonded to one axial end. The alloy ingot 110 forms a continuous core of the alloy about which the electrode is to be formed. The ingot 110 is placed in a second mold 100 with the stub 15 down, and a second heat 320 of the alloy is poured into the mold, followed by a third heat 330, a fourth heat 340, and a fifth heat 350 to form a body of length "L" about the core 110. This produces an ingot 160 which is the vacuum arc electrode. The second through fifth heats bond, by fusion and/or mechanical compression from the solidification shrinkage of the molten metal, to each other and to the surface of the core 110 to provide a unitary, homogeneous, and defect free ingot 160. The ingot is the electrode which is used in the VAR process 400 to make the final consolidated ingot 500. Note that the description refers to a five heat combination; however, it should also be noted that fewer or more heats than five can be consolidated by the process of the invention. The number of heats required for any electrode is determined by the intended product, the alloy, the size of the induction skull melting crucible, and the range of lengths and diameters of electrodes which can be melted in the VAR equipment.

Figure 4:
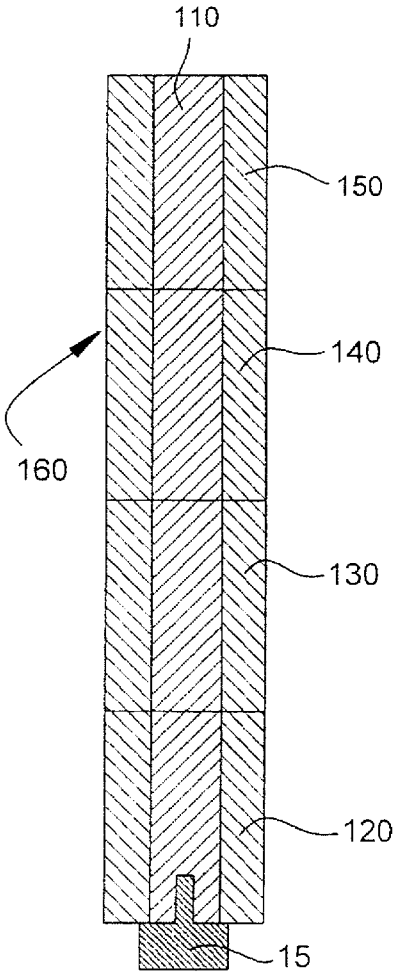
FIG. 4 is a schematic sectional elevation view of a completed electrode as formed from 5 heats of induction melted reactive metal alloy.
Figure 3:
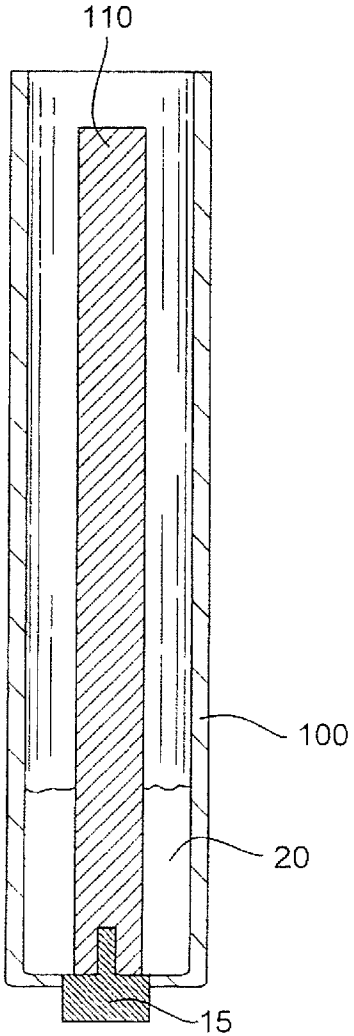
FIG. 3 is a schematic sectional elevation view of a mold containing a solidified electrode core, as formed in FIG. 2, and a single molten heat of induction melted reactive metal alloy to form a first portion of the electrode body at the desired finished diameter.
Figure 2:
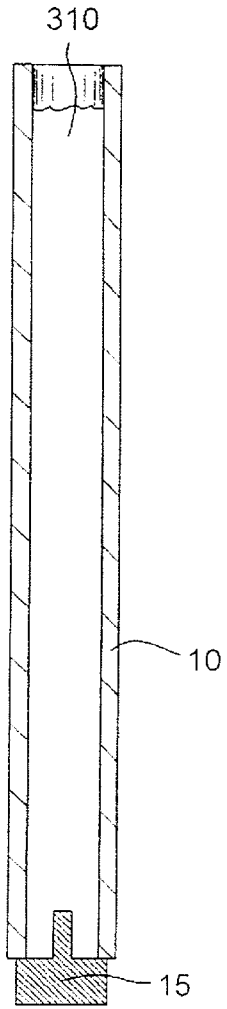
FIG. 2 is an schematic sectional elevation view illustrating a mold, atop an electrical contact stub, containing a single heat of molten reactive metal alloy to form an arc melting electrode core according to the invention.

FIG. 2 shows a sectional view of the first mold 10 with the stub 15 at the bottom and the molten first ISM heat 310. FIG. 3 shows the solid ingot 110 from the first mold 10 placed in a second mold 100 with the second molten ISM heat 320 poured about it. FIG. 4 shows a sectional view of the solid finished electrode 160. The core 110, stub 15, and the four body portions 120, 130, 140, and 150 are firmly bonded by limited fusion during casting or by combined fusion and mechanical compression bonding due to shrinkage during solidification. This results in an electrode with excellent strength, electrical continuity, cleanliness, and homogeneity.

Figure 5:
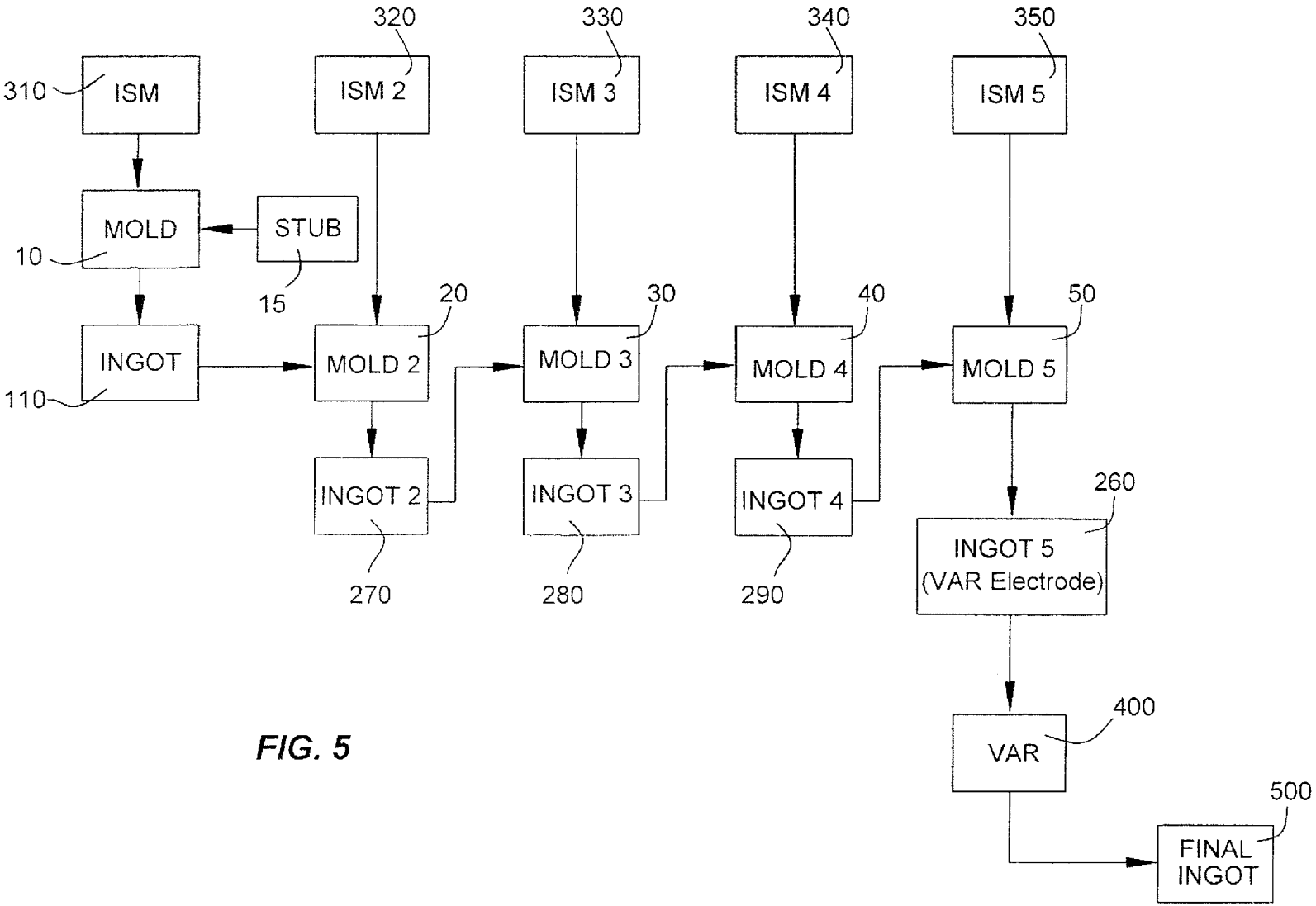
FIG. 5 is a flow chart showing the steps for making an electrode from multiple heats of induction melted reactive metal alloy for use in vacuum arc remelting to form an ingot according to an alternative embodiment of the invention.
Figure 8:
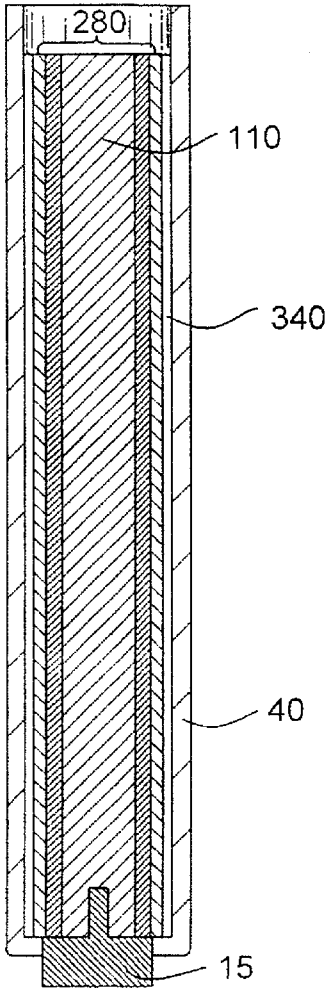
FIGS. 7, 8, and 9 illustrate molds containing the electrode core, the solidified layers of the electrode body formed in the previous figures, and a single molten heat of induction melted reactive metal alloy to form the second, third, and fourth layers, respectively, of the electrode body.
Figure 7:
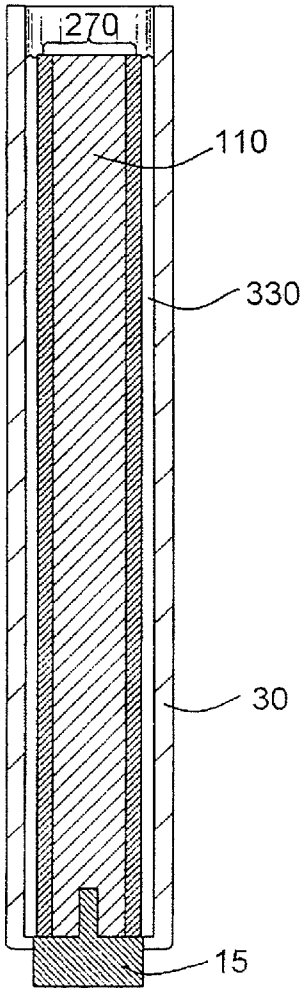
Figure 6:
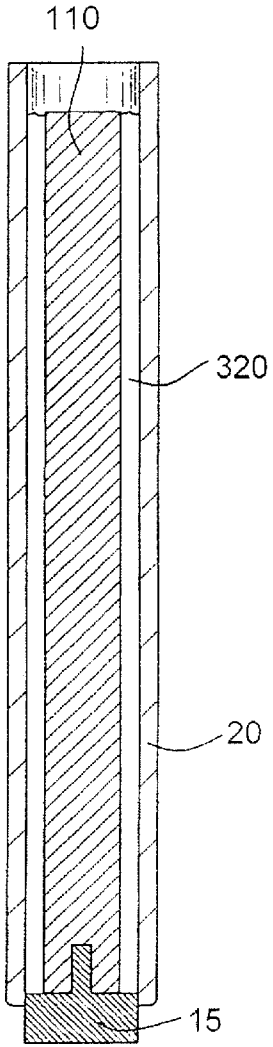
FIG. 6 is a schematic sectional elevation view of a mold containing a solidified electrode core, as formed in FIG. 2, and a single molten heat of induction melted reactive metal alloy to form a first layer of the electrode body according to said alternative embodiment.

The block diagram of FIG. 5 shows an alternative process for forming a homogeneous electrode from five ISM heats of reactive metal alloy and its use in VAR to make a final ingot 500. An electrical connection stub 15, with a diameter "$d \mp \Delta d$" and an axially extending pin, as described above, is placed in a first mold 10, of a diameter "d". Note that the length of all molds of the process is greater than the desired length "L" of the finished electrode. A first ISM heat of reactive metal alloy 310 is poured in the mold and, when removed, yields an ingot 110 of length "L" and diameter "d" with the stub 15 fused and/or mechanically bonded to one axial end. This is placed in a second mold 20 of diameter "$\sqrt{2}d$", and a second ISM heat 320 is poured around the ingot 110 to form a second ingot 270 having the stub 15 at one axial end, a length "L", and a diameter "$\sqrt{2}d$". Ingot 270 is placed in a third mold 30 of diameter "$\sqrt{3}d$" and a third ISM heat 330 of reactive metal alloy is poured into the mold around the ingot. The resulting solid ingot 280 is placed in a fourth mold 40 of diameter "2d" and a fourth ISM heat 340 of alloy is poured into the mold to form a fourth ingot 290. Ingot 290 is placed in a mold 50 of diameter "$\sqrt{5}d$", and a fifth ISM heat of alloy is poured in the mold about the ingot 290 and allowed to solidify to yield a fifth ingot 260 of diameter "$\sqrt{5}d$" which, with its contact stub, forms the VAR electrode. The electrode 260 is used in the VAR process 400 to make the final ingot 500.

This process is less desirable than that of FIG. 1; because it requires three more molds and significantly more labor than does the first process. In some cases it may, however, be preferred depending on the required finished length of the VAR electrode. Very long electrodes, due to the axial continuity of the body layers, would favor the alternative process, while electrodes of normal length would favor the first process with its radial continuity in the body layers.

Figure 10:
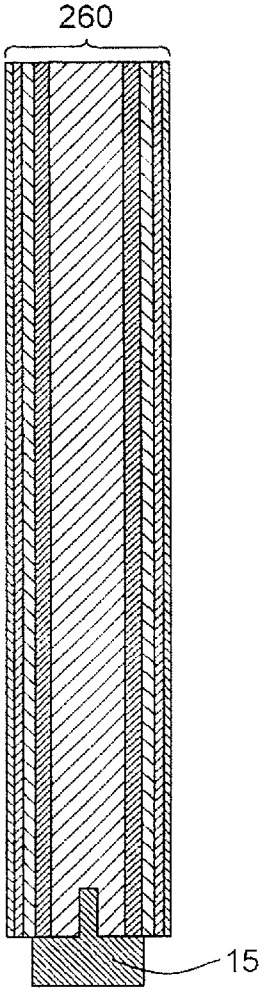
FIG. 10 is a schematic sectional elevation view of a completed electrode formed from 5 heats of induction melted alloy according to the alternative embodiment of the invention.
Figure 9:
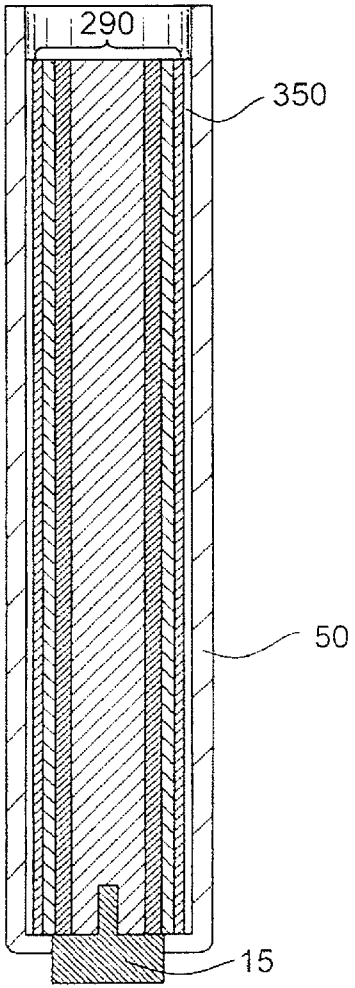

The stages of the electrode fabricated by the process of FIG. 5 are illustrated in FIGS. 1 and 6–10, all of which are sectional elevation views of the electrode as it is built up from the core 110 formed in the mold 10 from heat 310 in FIG. 1 to the finished multilayer electrode formed by that core and the four layers of body formed about it. Thus, FIGS. 6, 7, 8, and 9 show the first ingot 110, the second ingot 270, the third ingot 280, and the fourth ingot 290 in molds 20, 30, 40, and 50, respectively, with the molten second 320, third 330, fourth 340, and fifth 350 ISM heats poured about the ingots. The resulting fifth ingot 260 is shown in FIG. 10 to comprise the core 110, with the electrical connection stub 15 at the lower axial end, and the four body portions 220, 230, 240, and 250 layered about the core. The ingot 260 is the electrode for the VAR process in which the final consolidated ingot 500 is produced.

Figure 11:
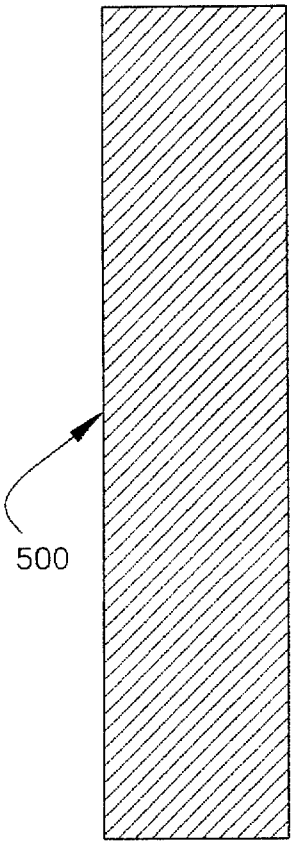
FIG. 11 is a schematic sectional elevation view of a homogeneous ingot made by vacuum arc remelting of an electrode produced, according to the invention, from a plurality of heats of induction skull melted reactive metal alloy.

The ingot shown in FIG. 11 results from VAR of an electrode made by either of the methods of the invention it is homogeneous and can be made several times larger than ingots which could otherwise be made from single heats of ISM metal. It, therefore, enables production of large fabrications and forgings.

The invention combines the ISM and VAR processes in such a manner as to virtually eliminate the limitations of each process in the unique combination process disclosed. The ingot core produced with the first ISM heat is continuous, both mechanically and electrically, and is relatively long; thereby providing a sturdy core about which the subsequently melted heats of alloy are poured to form the final ingot or electrode body with no need for welding or the potential defects associated with welding of reactive metals. This is an important advantage, since many reactive metal alloys, e.g., TiAl, have poor or no weldability. The pure stub (titanium—for titanium-based alloys; zirconium—for zirconium-based alloys; etc.) provides a means for making positive electrical contact without welding. Finally, the ingot chemistry produced by the combined ISM and VAR processes is very uniform, due to stirring action of ISM, and free of porosity and pipe, due to hot-top capability of VAR. The result is a large multi-heat ingot having the uniformity attributable to ISM and the size attributable to VAR.

Although the foregoing discussion relates to ISM, as the preferred induction melting process for melting reactive metal alloys; other induction melting processes may be equally well suited for some alloys in some less critical applications. Of course, such applications are contemplated in the appended claims.

Having described the invention, I claim:

1. A homogeneous electrode of reactive metal alloy, comprising:

an axially disposed unitary core comprising one induction melted heat of said reactive metal alloy and having a diameter "d" and a length "L"; and a body having an outer diameter of at least √2 times "d" and length "L", said body being disposed about said core, and comprising a number "x" of equal-sized induction melted heats of said reactive metal alloy.

2. The electrode of claim 1, further comprising:

means for attaching an electrical current source for arc remelting of said electrode.

3. The electrode of claim 2, wherein the means for attaching an electrical current source comprises a stub having a diameter proportional to "d", an axially extending small diameter pin, and the same composition as the primary alloying element of the reactive metal alloy, said stub being fused to an axial end of said core and said body during casting of said electrode.

4. The electrode of claim 1, wherein each of said number "x" of induction melted heats of said body forms an annular layer over said core with an outside diameter at least √2 times "d" and a length "L/x".

5. The electrode of claim 1, wherein each of said number "x" of induction melted heats of said body forms a cylindrical layer with an outside diameter greater than that of a previous layer and a length "L".

6. A method for making a single homogeneous electrode from a plurality of induction melted heats of reactive metal alloy for vacuum arc remelting, comprising the steps of:

induction melting a heat of said reactive metal alloy in a cold crucible;

casting said heat of reactive metal alloy in a first mold of diameter "d" and length greater than "L" to produce an ingot having a diameter "d" and length "L";

placing said ingot in a second mold of diameter greater than "d" and length greater than "L", to provide a solid core;

induction melting a plurality of additional heats of said reactive metal alloy in a cold crucible; and serially pouring said plurality of additional heats into said second mold to provide a body of length "L" disposed about said solid core.

7. The method of claim 6, comprising the further step of:

providing means at an axial end of said mold for attaching an electrical current source.

8. The method of claim 7, wherein the step of providing means for connecting an electrical current source comprises placing a stub at the bottom of the first mold prior to pouring the first heat into the mold, said stub having a diameter proportional to "d", an axially extending small diameter pin, and a composition the same as the primary alloying element of the reactive metal alloy.

9. A method for making a homogeneous ingot from a plurality of induction melted reactive metal alloy heats, comprising the steps of:

fabricating an electrode by induction melting a first heat of said reactive metal alloy in a cold crucible;

casting said heat of reactive metal alloy in a first mold of diameter "d" and length greater than "L" to produce an ingot having a diameter "d" and length "L";

placing said ingot in a second mold of diameter greater than "d" and length greater than "L", to provide a solid core;

serially induction melting a remainder of said plurality of heats of said reactive metal alloy in a cold crucible;

serially pouring the remainder of said plurality of additional heats into said second mold to provide a body of length "L" disposed about said solid core; and using said electrode in a vacuum arc remelting process to produce a final homogeneous ingot.

10. A method for making a homogeneous ingot from a plurality of induction melted reactive metal alloy heats, comprising the steps of:

1) induction melting a first heat of said reactive metal alloy in a cold crucible;

2) casting said heat of reactive metal alloy in a first mold of diameter "d" and length greater than "L" to produce an ingot having a diameter "d" and length "L";

3) placing said ingot in a second mold of diameter greater than "d" and length greater than "L", to provide a solid core;

4) induction melting a second heat of said reactive metal alloy in a cold crucible;

5) pouring said second heat into said second mold to produce an ingot having a first layer of a body of length "L" disposed about said solid core;

6) repeating steps 3, 4, and 5 using molds of increasing diameter, until said plurality of induction melted heats have been cast, to produce an electrode having a length "L" and a diameter as required for vacuum arc remelting; and 7) using said electrode in a vacuum arc remelting process to produce a final homogeneous ingot.

* * * * *